US010105032B2

(12) United States Patent
Wilson

(10) Patent No.: US 10,105,032 B2
(45) Date of Patent: Oct. 23, 2018

(54) APPLIANCE WITH A RETRACTABLE AND SLIDABLE DOOR

(71) Applicant: Midea Group Co., Ltd., Beijiao (CN)

(72) Inventor: Mark Wilson, Simpsonville, KY (US)

(73) Assignee: Midea Group Co., Ltd., Beijiao, Shunde, Foshan, Guangdong (CN)

( * ) Notice: Subject to any disclaimer, the term of this patent is extended or adjusted under 35 U.S.C. 154(b) by 0 days.

(21) Appl. No.: 15/281,967

(22) Filed: Sep. 30, 2016

(65) Prior Publication Data

US 2018/0092507 A1 Apr. 5, 2018

(51) Int. Cl.

| | |
|---|---|
| ***D06F 37/28*** | (2006.01) |
| ***A47L 15/42*** | (2006.01) |
| ***H05B 6/64*** | (2006.01) |
| ***D06F 39/00*** | (2006.01) |
| ***D06F 58/20*** | (2006.01) |
| ***A47L 15/50*** | (2006.01) |

(52) U.S. Cl.

CPC ..... *A47L 15/4257* (2013.01); *A47L 15/4265* (2013.01); *A47L 15/4293* (2013.01); *A47L 15/50* (2013.01); *D06F 37/28* (2013.01); *D06F 39/005* (2013.01); *D06F 58/20* (2013.01); *H05B 6/6414* (2013.01)

(58) Field of Classification Search

CPC .. A47L 15/50; A47L 15/4257; A47L 15/4265; A47L 15/4293; D06F 37/28; D06F 39/005; D06F 58/20; H05B 6/6414

USPC ..... 312/228; 68/3 R, 139

See application file for complete search history.

(56) References Cited

U.S. PATENT DOCUMENTS

| | | | | |
|---|---|---|---|---|
| 1,502,872 A | | 7/1924 | Oberg | |
| 2,949,208 A | * | 8/1960 | Widigen | D06B 5/00 16/400 |
| 3,050,211 A | * | 8/1962 | Martin | D06F 37/28 220/213 |
| 3,240,038 A | * | 3/1966 | Schwegler | D06F 37/28 220/232 |
| 3,714,737 A | | 2/1973 | Fillion et al. | |
| 4,531,387 A | | 7/1985 | Cotton et al. | |

(Continued)

FOREIGN PATENT DOCUMENTS

| | | |
|---|---|---|
| CN | 101498465 A | 8/2009 |
| CN | 201942913 | 8/2011 |

(Continued)

OTHER PUBLICATIONS

Reason Washing Machine, http://www.washeranddryerdirect.com/reason-washing-machine/, Feb. 11, 2016.

(Continued)

*Primary Examiner* — James O Hansen

(74) *Attorney, Agent, or Firm* — Middleton Reutlinger

(57) ABSTRACT

Apparatus relating to an appliance having a housing with an aperture providing access to an interior compartment of the appliance and a door are disclosed herein. In various embodiments, the door may be designed to slide and retract within the housing when actuating between at least a closed position and an open position. Additionally, the door may be designed in various styles, wherein the particular style of door chosen may be dependent upon the particular appliance.

19 Claims, 9 Drawing Sheets

(56) References Cited

U.S. PATENT DOCUMENTS

| | | | | |
|---|---|---|---|---|
| 5,724,837 | A * | 3/1998 | Shin | D06F 37/28 160/188 |
| 6,237,374 | B1 | 5/2001 | Malchow et al. | |
| 6,550,291 | B2 | 4/2003 | Uhlin et al. | |
| 7,064,296 | B1 | 6/2006 | Harned et al. | |
| 7,490,495 | B2 | 2/2009 | Kim | |
| 7,614,263 | B2 | 11/2009 | Kim et al. | |
| 2003/0146203 | A1 | 8/2003 | Wang | |
| 2006/0086152 | A1 | 4/2006 | Kim et al. | |

FOREIGN PATENT DOCUMENTS

| | | | |
|---|---|---|---|
| CN | 103334272 | A | 10/2013 |
| CN | 203531661 | U | 4/2014 |
| CN | 104746300 | A | 7/2015 |
| CN | 205347813 | U | 6/2016 |
| EP | 1333118 | A8 | 11/2003 |
| EP | 1408150 | A1 | 4/2004 |
| EP | 1367169 | B1 | 2/2010 |
| EP | 2107152 | B1 | 6/2014 |
| JP | 2005305009 | A | 11/2005 |
| WO | 0212613 | A1 | 2/2002 |

OTHER PUBLICATIONS

International Search Report and Written Opinion issued in Application No. PCT/CN2017/102143 dated Dec. 27, 2017.

* cited by examiner

APPLIANCE WITH A RETRACTABLE AND SLIDABLE DOOR

BACKGROUND

Conventional appliances, including clothing washers, clothing dryers, dishwashers, microwave ovens, etc., are a mainstay in residential housing and/or commercial operations across the world and often used daily. In some instances, these appliances may occupy a large area of a small room, e.g., a clothing washer and clothing dryer in a laundry room, which leaves a user a small area to maneuver.

Many of these appliances have an interior compartment where items operated upon by the particular appliance are placed. For example, a clothing washer may include a washing drum to place a load of laundry for washing and a clothing dryer may include a drying tumbler to place the load of laundry for drying. Similarly, an oven may include a cooking chamber to place a bag of popcorn for cooking. Access to these various types of interior compartments is generally provided through apertures, which are typically sealed or otherwise closed through the use of hinged doors.

Hinged doors, however, present a number of drawbacks in many appliance applications. First, hinged doors swing open on a rotational axis and require a swing clearance. The required swing clearance further limits the user's already small area to maneuver. Second, hinged doors are more susceptible to damage when they are in an opened position. Possible damage may result from an inadvertent force being placed on the hinged door, e.g., a person leaning on the hinged door in the open position, or deterioration of an exposed seal due to opening and closing the hinged door.

Moreover, when the user opens a hinged door of an appliance, the user's hands are likely pre-occupied with what they will put in the interior compartment of the appliance. For example, if the user is transferring a load of laundry from a clothing washer to a clothing dryer, then the user will have to manually open the doors to both the clothing washer and clothing dryer and transfer the load. The open doors may be cumbersome and obstruct the path of transferring the load from the clothing washer to the clothing dryer. Additionally, if the user forgets to open the door to the clothing dryer after removing the load from the clothing washer, then the user must place the load back into the clothing washer before transferring the load of laundry.

Accordingly, there is a need in the art for overcoming the issues of existing appliances.

SUMMARY

Generally, in one aspect, an appliance is presented that includes a housing with an aperture extending along a plane and providing access to an interior compartment of the appliance, and a door that is slidable and retractable between at least a closed position and an open position to selectively restrict and provide access to the interior compartment of the appliance. At least a portion of the door may be configured to move substantially parallel to the plane of the aperture and across the aperture when actuating between the closed position and the open position.

In some embodiments, the aperture may be defined by a top surface of the housing. In other embodiments, the aperture may be defined by a front surface of the housing. In some embodiments, the door may be configured to seal the aperture in the closed position. The seal may be any type of mechanical seal known in the art, e.g., an adhesive seal, a diaphragm seal, etc.

In some embodiments, the appliance may further comprise at least one actuation mechanism connected to the door. Operation of the at least one actuation mechanism may enable the door to slide and retract between the closed position and the open position. In some embodiments, the operation of the at least one actuation may be automatically controlled, e.g., a push button, a control algorithm, etc. In other embodiments, the operation of the at least one actuation mechanism may be manually controlled, e.g., at least one thumb slider, a lever system, etc. One of skill in the art will recognize that the aforementioned actuation mechanisms are for exemplary purposes and not meant to be limiting.

In some embodiments, the door may include at least three panels configured in an iris arrangement. The iris arrangement of the door is very similar to that of an iris arrangement of a camera lens diaphragm that covers the camera aperture. In some embodiments, the door may further include at least a base plate within the housing and actuating ring within the housing, which enables sliding and retraction of each of the at least three panels when actuating between the closed position and the open position. In some embodiments, each of the at least three panels may be configured to overlap in the closed position, thus creating an overlapping iris door. In some embodiments, each of the at least three panels of the overlapping iris door retract and extend around a respective rotational axis when actuating between the closed position and the open position. In other embodiments, each of the at least three panels may be circular sectors configured to abut one another in the closed position, thus creating a non-overlapping iris door. In other embodiments, each of the at least three panels of the non-overlapping iris door retract and slide along a respective translational axis when actuating between the closed position and the open position.

In some embodiments, the door may include at least two panels arranged and configured as a pocket door. In some embodiments, the pocket door may include at least a track within the housing. In some embodiments, the track may be a linear track, wherein each of the at least two panels of the pocket door are slidable along the linear track when actuating between the closed position and the open position. In other embodiments, the track may be a curved track. In some embodiments, each of the at least two panels of the pocket door are slidable along the curved track when actuating between the closed position and the open position. In other embodiments, when the curved track is utilized, the door actuates similarly to that of a roll-top style door.

In some embodiments, the appliance may be various household and/or commercial appliances. In some embodiments, the appliance may be a clothing washer and the interior compartment may include a washing drum. In other embodiments, the appliance may be a clothing dryer and the interior compartment may include a drying tumbler. In other embodiments, the appliance may be a dishwasher and the interior compartment may include a washing rack. In other embodiments, the appliance may be an oven and the interior compartment may be a cooking chamber. One of skill in the art will recognize that the aforementioned appliances are for exemplary purposes and not meant to be limiting.

Generally, in yet another aspect, an appliance door is presented that includes at least three panels movable in an iris arrangement and disposed proximate to an aperture of an appliance housing extending along a plane and providing access to an interior compartment of an appliance. Each of the at least three panels is slidable and retractable between at least a closed position and an open position. Further, each of the at least three panels may be configured to move substantially parallel to the plane of the aperture and across the aperture when actuating between the closed position and the open position. Even further, the at least three panels close the aperture in the closed position and provide access to the interior compartment and are retracted into the appliance housing in the open position.

Generally, in yet another aspect, an appliance door is presented that includes at least two panels disposed proximate to an aperture of an appliance housing extending along a plane and providing access to an interior compartment of an appliance. Each of the at least two panels is slidable and retractable between at least a closed position and an open position. Further, each of the at least two panels may be configured to move substantially parallel to the plane of the aperture and across the aperture when actuating between the closed position and the open position. Even further, the at least two panels close the aperture in the closed position and provide access to the interior compartment and are retracted into the appliance housing in the open position. The appliance door further includes at least one track within the appliance housing and connected to each of the at least two panels. The at least one track enables actuation between the closed position and the open position.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, and emphasis instead generally placed upon illustrating the principles of the embodiments depicted.

DETAILED DESCRIPTION OF THE DRAWINGS

Figure 1:
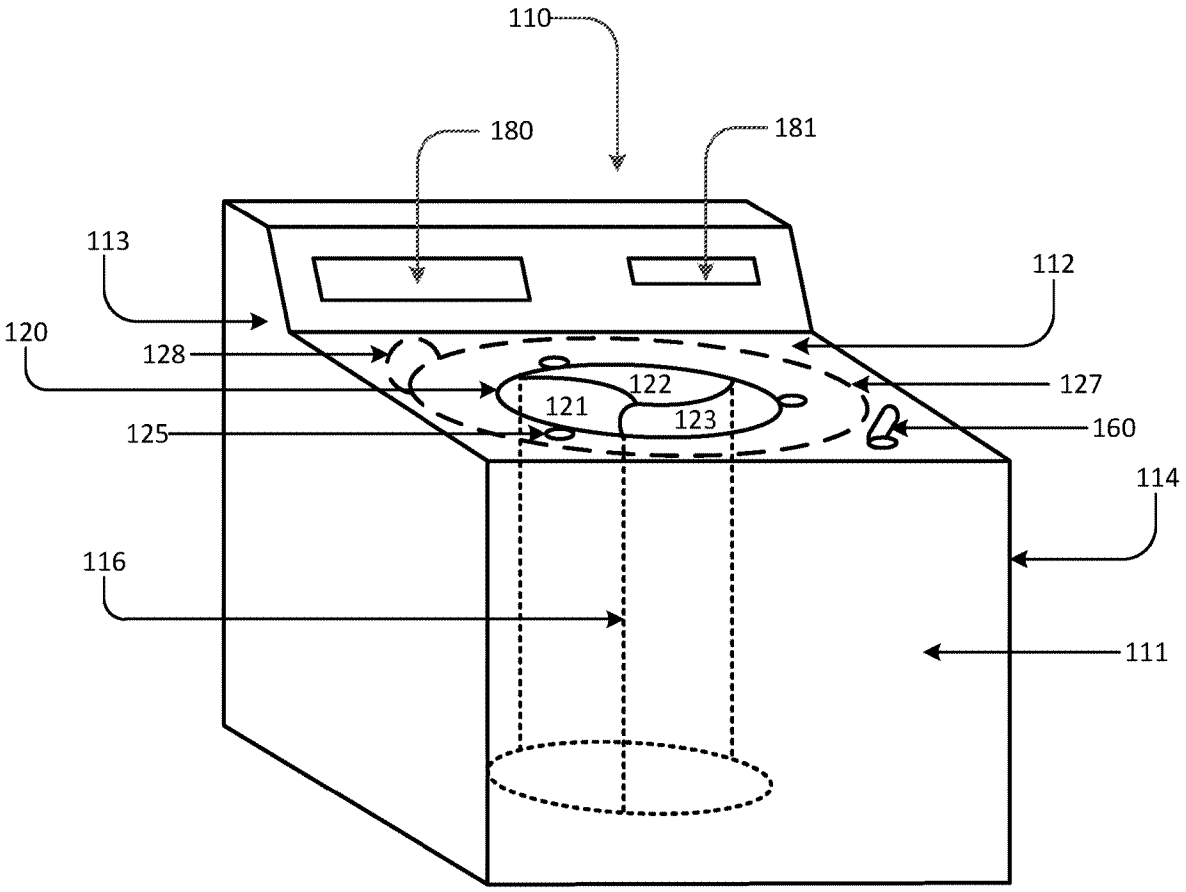
FIG. 1 is a perspective view of an example implementation of a clothing washer with an overlapping iris door in a closed position.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Generally, an appliance may include a housing, an aperture, an interior compartment, and a door. More particularly, the door may be configured and arranged to be slidable and retractable within the housing. The housing may include a plurality of surfaces and the aperture may be defined by one of the plurality of surfaces of the housing. The aperture may prevent access to the interior compartment of the housing when the door is in the closed position and may provide access to the interior compartment of the housing when the door is in the open position.

In some embodiments, the door may move slide and retract between the closed position and the open position upon operation of an actuation mechanism. In some embodiments, the actuation mechanism may automatically operable to close and/or open the door in response to a signal from a push button, electromechanical switch, etc. or in response to an operation cycle of an appliance being started or completed. In other embodiments, the actuation mechanism may be manually operable to close and/or open the door in response to a user physically moving the door.

The door may include a plurality of panels arranged in various configurations. In some embodiments, the plurality of panels of the door may be in an iris arrangement. In other embodiments, the plurality of panels may be in a pocket arrangement. In some embodiments, the door is configured to slide and retract into the housing to provide access to the interior compartment, and to slide and extend from the housing to close the aperture.

In some embodiments, each of the plurality of panels in the iris arrangement may retract around a respective rotational axis and into the housing when moving from the closed position to the open position. In some embodiments, each of the plurality of panels in the iris arrangement may extend around a respective rotational axis and out of the housing when moving from the open position to the closed position. In other embodiments, each of the plurality of panels in the iris arrangement may slide along a respective translational axis and into the housing when moving from the closed position to the open position. In other embodiments, each of the plurality of panels in the arrangement may slide along a respective translational axis out of the housing when moving from the open position to the closed position.

In some embodiments, each of the plurality of panels in the iris arrangement may retract around a respective rotational axis and into the housing when moving from the closed position to the open position. In some embodiments, each of the plurality of panels in the iris arrangement may extend around a respective rotational axis and out of the housing when moving from the open position to the closed position. In other embodiments, each of the plurality of panels in the iris arrangement may slide along a respective translational axis and into the housing when moving from the closed position to the open position. In other embodiments, each of the plurality of panels in the arrangement may slide along a respective translational axis out of the housing when moving from the open position to the closed position.

In some embodiments, each of the plurality of panels in the pocket arrangement may slide along a linear track into the housing when moving from the closed position to the open position. In some embodiments, each of the plurality of panels in the pocket arrangement may slide along a linear track out of the housing when moving from the open position to the closed position. In some embodiments, each of the plurality of panels in the pocket arrangement may slide along a curved track into the housing when moving from the closed position to the open position. In some embodiments, each of the plurality of panels in the pocket arrangement may slide along a curved track out of the housing when moving from the open position to the closed position.

The type of door may vary from one appliance to the next. For example, the appliance may be a clothing washer and the door may be configured in a pocket arrangement. As yet another example, the appliance may be an oven and the door may be configured in an iris arrangement. The Figures illustrate various embodiments of appliances and doors, and are for exemplary purposes. It will be appreciated, however, that other slidable and retractable door arrangements may be employed in other embodiments, and that such other arrangements will be apparent to those of ordinary skill in the art having the benefit of the instant disclosure. Therefore, the invention is not limited to the specific embodiments herein.

Figure 2:
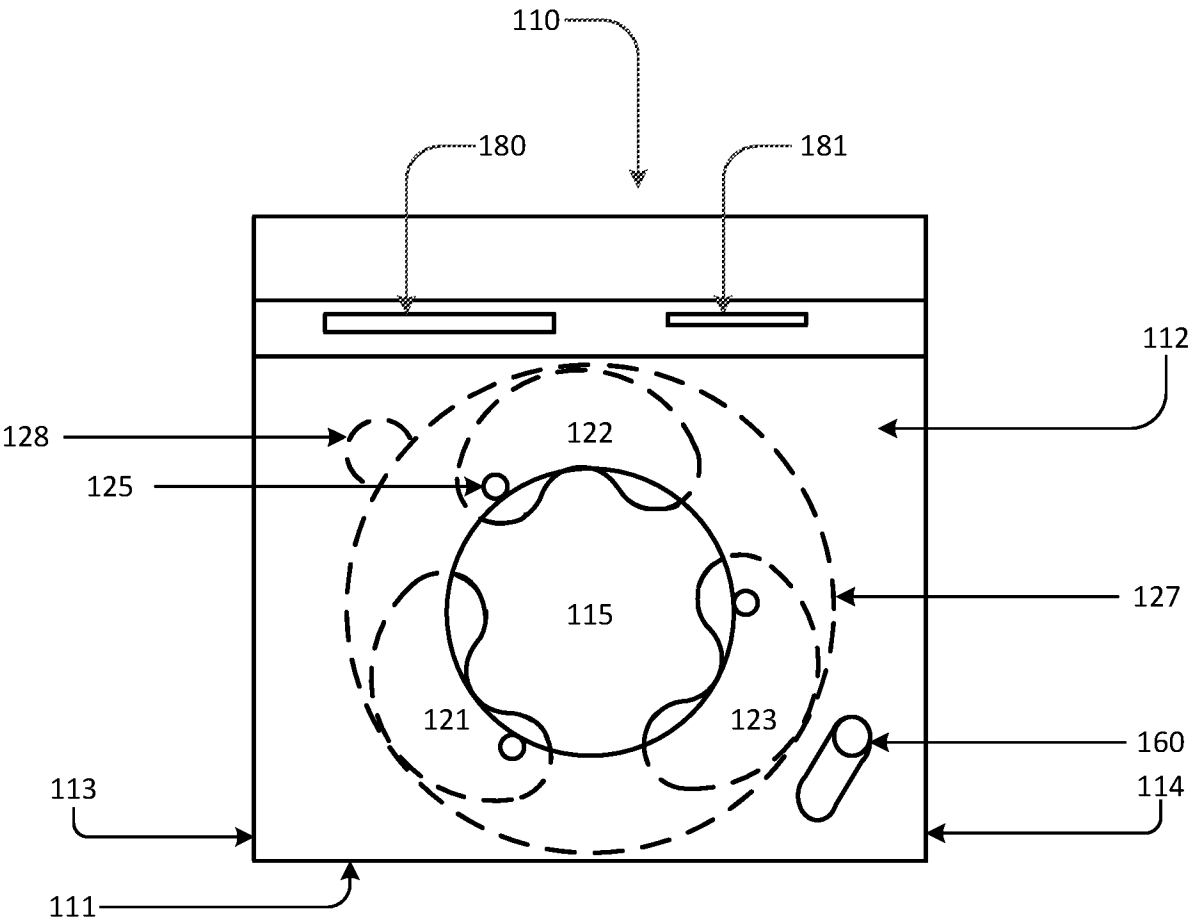
FIG. 2 is a top view of the clothing washer of FIG. 1 with the overlapping iris door in an open position.

Referring initially to FIG. 1 and FIG. 2, an embodiment of an appliance, a clothing washer, is depicted having a housing or cabinet 110, an aperture 115, an interior compartment 116, and one example implementation of a slidable and retractable door taking the form of an overlapping iris door 120. The housing 110 is defined in part by a front surface 111, a top surface 112, a first side surface 113, and a second side surface 114. The appliance may also include an appliance control system 180 and an appliance display 181. The appliance control system 180 allows a user to select various operational modes for the appliance and the appliance display 181 provides the user with a status of the selected operational mode. For example, the user may select a wash cycle for delicate clothing using the appliance control system 180 and monitor the status of the wash cycle using the appliance display 181. In the depicted embodiment, the aperture 115 is defined by the top surface 112 of the housing 110, and the aperture 115 extends along a plane substantially parallel with the top surface 112 of the housing 110. Additionally, the interior compartment 116 includes a washing drum.

In FIG. 1, the overlapping iris door 120 is depicted in the closed position, such that the aperture 115 is closed, and in some instances sealed, and the interior compartment 116 is not accessible from outside the appliance. The overlapping iris door 120 includes at least a first panel 121, a second panel 122, and a third panel 123, which are disposed proximate to the aperture 115. In the closed position, the first panel 121, the second panel 122, and the third panel 123 at least partially overlap one another, hence the name overlapping iris door 120, to close the aperture 115. Each of the first panel 121, the second panel 122, and the third panel 123 is connected to a base plate 127 within the housing 110 by a respective coupling mechanism 125 within the housing 110. Each respective coupling mechanism 125 may be a bolt, screw, and/or any mechanism that connects each panel 121-123 to the base plate 127 and allows each panel 121-123 to retract and/or extend about its respective coupling mechanism 125. Further, an actuating ring 128 within the housing 110 is connected to the base plate 127 and to each panel 121-123 by each respective coupling mechanism 125. Upon actuation, rotation of the actuating ring 128 will move the overlapping iris door 120 between the closed position (FIG. 1) and the open position (FIG. 2).

The actuating ring 128 is connected to an actuation mechanism and allows the overlapping iris door 120 to move between the closed position and the open position. In the depicted embodiment of FIG. 1, the actuation mechanism is a thumb slider 160 and is in a first position, which corresponds to the overlapping iris door 120 in the closed position. In the depicted embodiment of FIG. 2, the thumb slider 160 is in a second position, which corresponds to the overlapping iris door 120 in the open position. The thumb slider 160 is a manual actuation mechanism and requires a user to actuate the thumb slider 160 between the first position and the second position to actuate the overlapping iris door 120 between the closed position and the open position.

In use, when the user actuates the thumb slider 160 from the first position towards the second position, the overlapping iris door 120 actuates from the closed position to the open position. The overlapping iris door 120 moves substantially parallel to the plane of the aperture 115 and across the aperture 115. Each panel 121-123 retracts around a respective rotational axis defined by each respective coupling mechanism 125. When the thumb slider 160 reaches the second position, the overlapping iris door 120 is in the open position and will be substantially similar to that depicted in FIG. 2.

FIG. 2 provides a view of the top surface 112 of the housing 110, wherein the overlapping iris door 120 is depicted in the open position and the thumb slider 160 is in the second position, thus the aperture 115 is open and the interior compartment 116 is accessible from outside the appliance. The first panel 121, the second panel 122, and the third panel 123 are kidney-shaped; however, this is not meant to be limiting. The shape of each panel 121-123 is generally based on how many panels are utilized in arranging the overlapping iris door 120. For example, if six panels are utilized, then the six panels may be more rectangular-shaped than if only three panels are utilized. Additionally, as illustrated in FIG. 2, a majority of each panel 121-123 may be retracted within the housing 110 in the open position, but a small portion of each panel 121-123 may still project over the aperture 115. Much like the shape of each panel 121-123, the small portion of each panel 121-123 obstructing the aperture 115 may be based in part on how many panels are utilized in arranging the overlapping iris door 120. One of skill in the art may readily determine the number of panels utilized in configuring and arranging the overlapping iris door 120. Further, in some embodiments, the panels 121-123 may be entirely retracted beyond the boundary of the aperture 115, and in some embodiments, the shape of the aperture 115 may be non-circular, e.g., rectangular.

In use, when the user actuates the thumb slider 160 from the second position towards the first position, the overlapping iris door 120 actuates from the open position to the closed position. The overlapping iris door 120 moves substantially parallel to the plane of the aperture 115 and across the aperture 115. Each panel 121-123 extends around a respective rotational axis defined by each respective coupling mechanism 125. When the thumb slider 160 reaches the first position, the overlapping iris door 120 is in the closed position and will be substantially similar to that depicted in FIG. 1.

Figure 3:
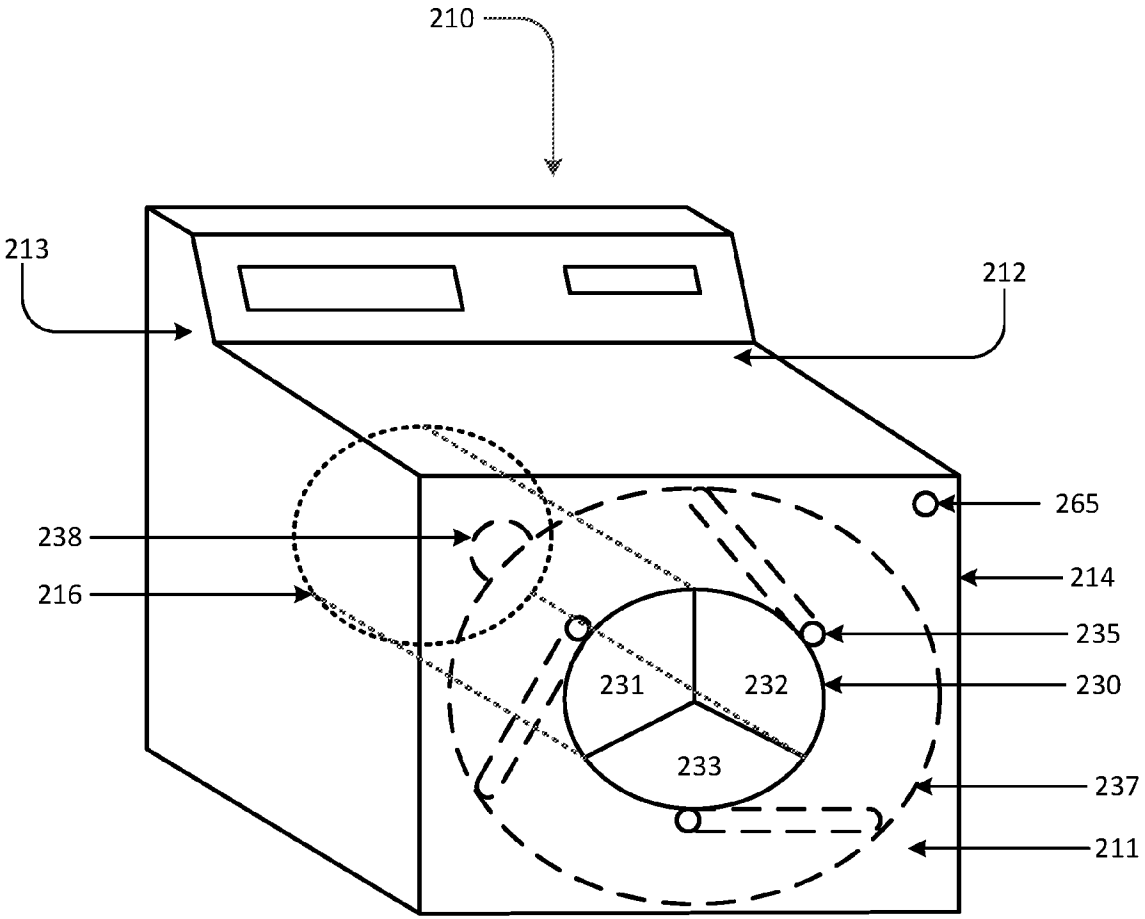
FIG. 3 is a perspective view of an example implementation of a clothing dryer with a non-overlapping iris door in a closed position.
Figure 4:
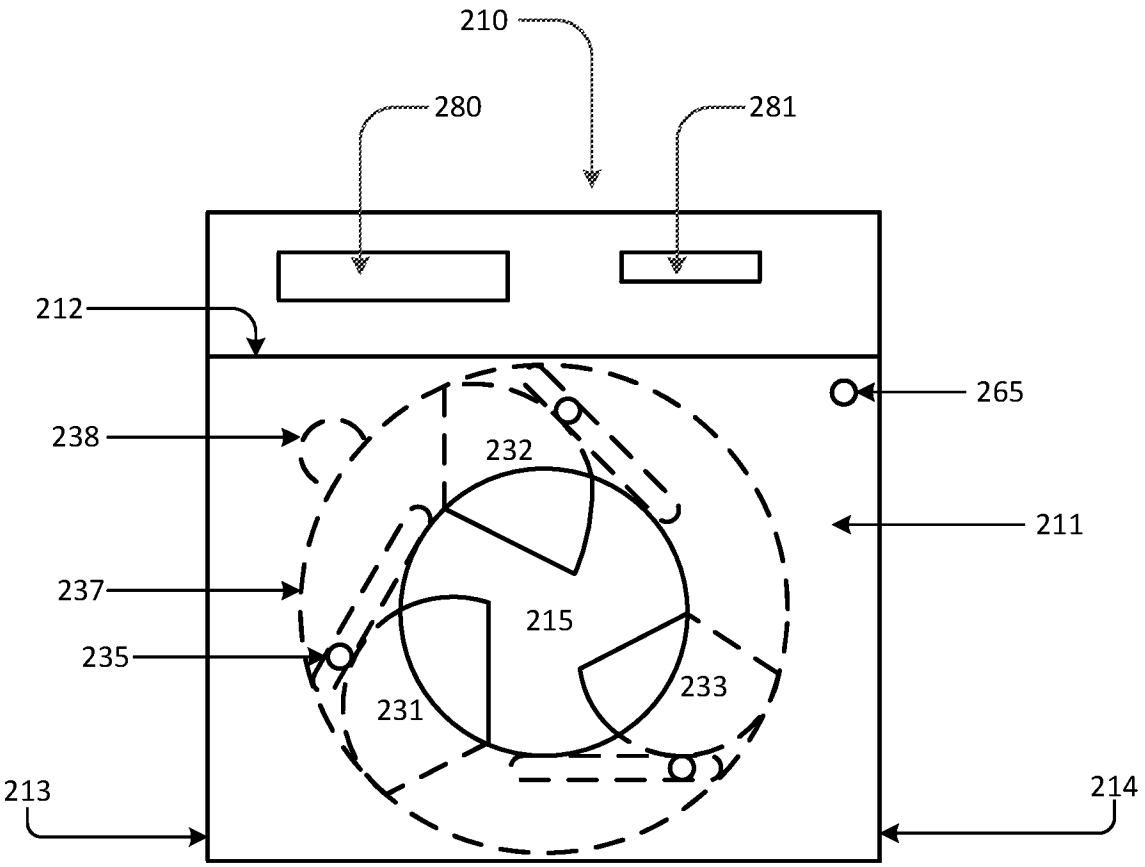
FIG. 4 is a front view of the clothing dryer of FIG. 3 with the non-overlapping iris door in an open position.

Referring now to FIG. 3 and FIG. 4, another embodiment of an appliance, here a clothing dryer, is depicted having a housing or cabinet 210, an aperture 215, an interior compartment 216, and another example implementation of a slidable and retractable door taking the form of a non-overlapping iris door 230. The housing 210 is defined in part by a front surface 211, a top surface 212, a first side surface 213, and a second side surface 214. The appliance may also include an appliance control system 280 and an appliance display 281. The appliance control system 280 allows a user to select various operational modes for the appliance and the appliance display 281 provides the user with a status of the selected operational mode. For example, the user may select a dry cycle for wet towels using the appliance control system 280 and monitor the status of the dry cycle using the appliance display 281. In the depicted embodiment, the aperture 215 is defined by the front surface 211 of the housing 210, and the aperture 215 extends along a plane substantially parallel with the front surface 211 of the housing 210. Additionally, the interior compartment 216 includes a drying tumbler.

In FIG. 3, the non-overlapping iris door 230 is depicted in the closed position, such that the aperture 215 is closed, and in some instances sealed, and the interior compartment 216 is not accessible from outside the appliance. The non-overlapping iris door 230 includes at least a first panel 231, a second panel 232, and a third panel 233, which are disposed proximate to the aperture 215. In the closed position, the first panel 231, the second panel 232, and the third panel 233 are configured to abut one another to close the aperture 215. Each of the first panel 231, the second panel 232, and the third panel 233 is connected to a base plate 237 within the housing 210 by a respective coupling mechanism 235 within the housing 210. Each respective coupling mechanism 235 may be a bolt, screw, and/or any mechanism that connects each panel 231-233 to the base plate 237 and allows each panel 231-233 to slide along its respective coupling mechanism 235. Further, an actuating ring 238 within the housing 210 is connected to the base plate 237 and to each panel 231-233 by each respective coupling mechanism 235. Upon actuation, rotation of the actuating ring 238 will move the non-overlapping iris door 230 between the closed position (FIG. 3) and the open position (FIG. 4).

The actuating ring 238 is connected to an actuation mechanism and allows the non-overlapping iris door 230 to move between the closed position and the open position. In the depicted embodiment of FIG. 3, the actuation mechanism is a push button 265 connected to a motor drive. The motor drive may be a linear motor, a rotary motor, a rack and pinion, etc. If the non-overlapping iris door 230 is in the closed position and a user presses the push button 265, then the non-overlapping iris door 230 will actuate to the open position. If the non-overlapping iris door 230 is in the open position and the user presses the push button 265, then the non-overlapping iris door 30 will actuate to the closed position.

In use, when the user presses the push button 265, the non-overlapping iris door 230 slides from the closed position to the open position. The non-overlapping iris door 230 moves substantially parallel to the plane of the aperture 215 and across the aperture 215. Each panel 231-233 slides along a respective translational axis defined by each respective coupling mechanism 235. When the push button 265 is pressed, the non-overlapping iris door 230 actuates to the open position and will be substantially similar to that depicted in FIG. 4.

FIG. 4 provides a view of the front surface 211 of the housing 210, wherein the non-overlapping iris door 230 is depicted in the open position, thus the aperture 215 is open and the interior compartment 216 is accessible from outside the appliance. The first panel 231, the second panel 232, and the third panel 233 are circular sectors; however, this is not meant to be limiting. The shape of each panel 231-233 is generally based on how many panels are utilized in arranging the non-overlapping iris door 230. Additionally, as illustrated in FIG. 4, a majority of each panel 231-233 may be retracted within the housing 210 in the open position, but a small portion of each panel 231-233 may still project over the aperture 215. Much like the shape of each panel 231-233, the small portion of each panel 231-233 obstructing the aperture 215 may be based in part on how many panels are utilized in arranging the non-overlapping iris door 230. One of skill in the art may readily determine the number of panels utilized in configuring the non-overlapping iris door 230. Further, in some embodiments, the panels 231-233 may be entirely retracted beyond the boundary of the aperture 215, and in some embodiments, the shape of the aperture 215 may be non-circular, e.g., rectangular.

In use, when the user presses the push button 265, the non-overlapping iris door 230 actuates from the open position to the closed position. The non-overlapping iris door 230 moves substantially parallel to the plane of the aperture 215 and across the aperture 215. Each panel 231-233 slides along a respective translational axis defined by each respective coupling mechanism 235. When the push button 265 is pressed, the non-overlapping iris door 230 is in the closed position and will be substantially similar to that depicted in FIG. 3.

Figure 5:
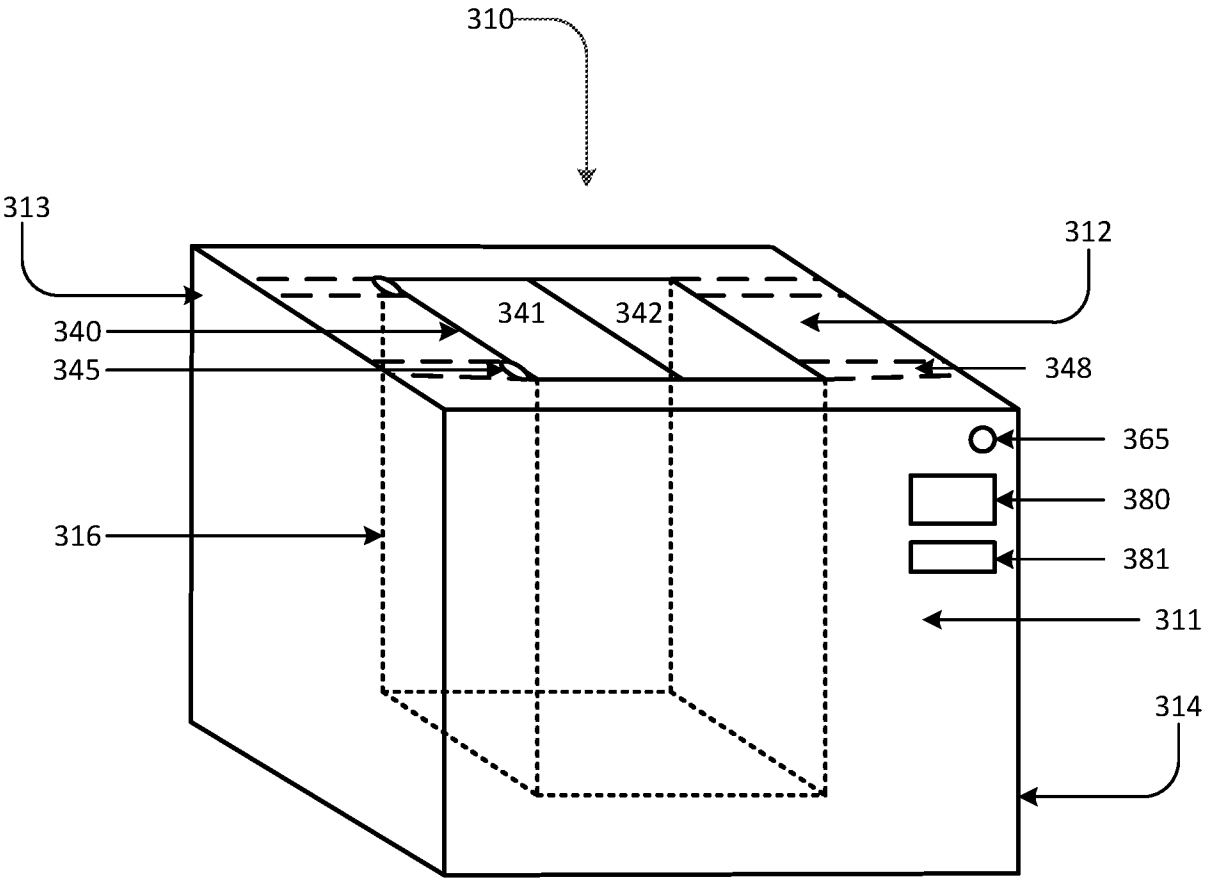
FIG. 5 is a perspective view of an example implementation of a dishwasher with a pocket door movable along a linear track and in a closed position.
Figure 6:
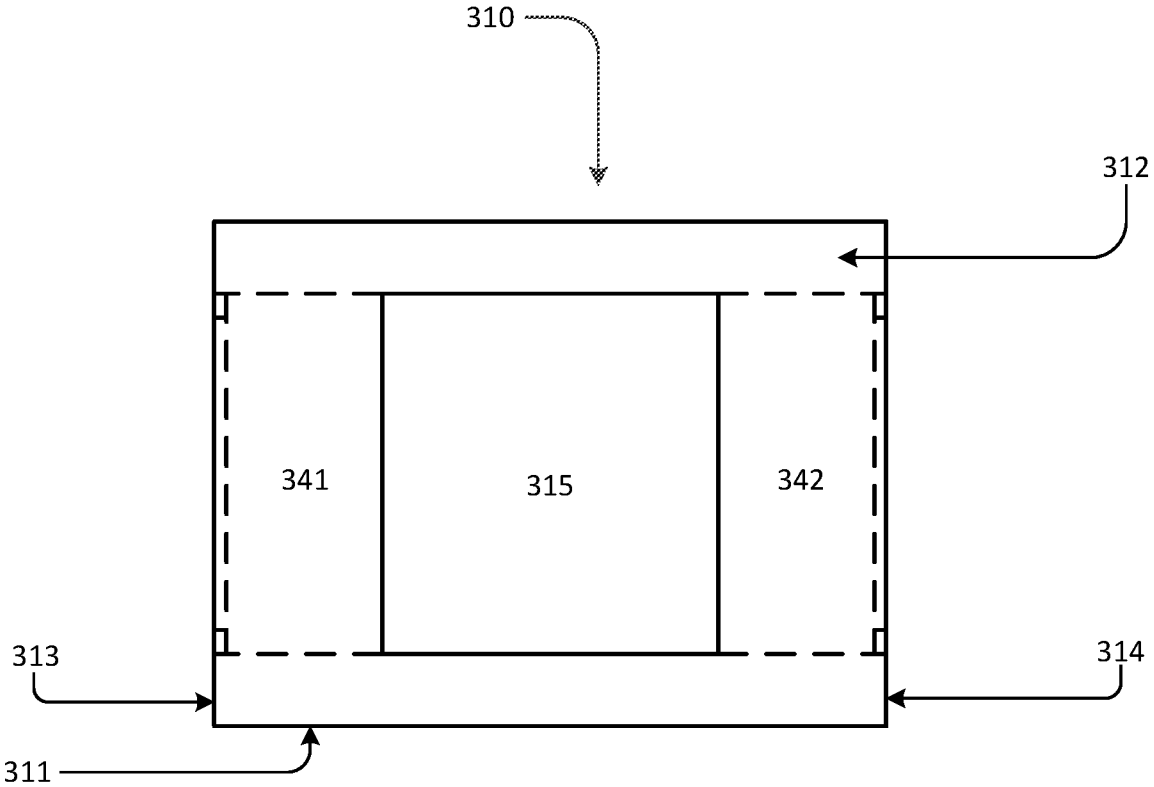
FIG. 6 is a top view of the dishwasher of FIG. 5 with the pocket door in an open position.

Referring now to FIG. 5 and FIG. 6, another embodiment of an appliance, here a dishwasher, is depicted having a housing or cabinet 310, an aperture 315, an interior compartment 316, and another example implementation of a slidable and retractable door taking the form of a pocket door 340. The housing 310 is defined in part by a front surface 311, a top surface 312, a first side surface 313, and a second side surface 314. The appliance may also include an appliance control system 380 and an appliance display 381. The appliance control system 380 allows a user to select various operational modes for the appliance and the appliance display 381 provides the user with a status of the selected operational mode. For example, the user may select a wash cycle for a load of dishes using the appliance control system 380 and monitor the status of the wash cycle using the appliance display 381. In the depicted embodiment, the aperture 315 is defined by the top surface 312 of the housing 310, and the aperture 315 extends along a plane substantially parallel with the top surface 312 of the housing 310. Additionally, the interior compartment 316 includes a washing rack.

In FIG. 5, the pocket door 340 is depicted in the closed position, such that the aperture 315 is closed, and in some instances sealed, and the interior compartment 316 is not accessible from outside the appliance. The pocket door 340 includes at least a first panel 341 and a second panel 342, which are disposed proximate to the aperture 315. In the closed position, the first panel 341 and the second panel 342 are configured to abut one another in the center of the aperture 315 and to close the aperture 315. Each of at least the first panel 341 and the second panel 342 is connected to a linear track 348 within the housing 310 by a respective coupling mechanism 345 within the housing 310. The linear track 348 may be any appropriate plastic and/or metal or metal-alloy material. Each respective coupling mechanism 345 may be a wheel, chain, and/or any mechanism that connects each panel 341-342 to the linear track 348 and allows each panel 341-342 to slide along the linear track 348.

Each respective coupling mechanism 345 is connected to an actuation mechanism and allows the pocket door 340 to slide and retract between the closed position (FIG. 5) and the open position (FIG. 6). In the depicted embodiment of FIG. 5, the actuation mechanism is a push button 365 connected to a motor drive. The motor drive may be a linear motor, a rotary motor, a rack and pinion, etc. If the pocket door 340 is in the closed position and a user presses the push button 365, then the pocket door 340 will slide and retract to the open position. If the pocket door 340 is in the open position and the user presses the push button 365, then the pocket door 340 will slide and extend to the closed position.

In use, when the user presses the push button 365, the pocket door 340 begins to move from the closed position to the open position. The pocket door 340 moves substantially parallel to the plane of the aperture 315 and across the aperture 315. Each panel 341-342 will slide along a respective translational axis defined by the linear track 348, such that the first panel 341 slides along the linear track 348 towards the first side surface 313 and the second panel 342 slides along the linear track 348 towards the second side surface 314. The pocket door 340 slides and retracts to the open position and the pocket door 340 will be substantially similar to that depicted in FIG. 6. Also, the pocket door 340 is substantially similar to that of an elevator style door.

FIG. 6 provides a view of the top surface 312 of the housing 310, wherein the pocket door 340 is depicted in the open position, such that the aperture 315 is open and the interior compartment 316 is accessible from outside the appliance. The first panel 341 and the second panel 342 are rectangular; however, this is not meant to be limiting. The shape of each panel 341-342 is generally based on the shape of the aperture 315 and the appliance housing 310. Additionally, as illustrated in FIG. 6, each panel 341-342 may be fully retracted within the housing 310 when the pocket door 340 is in the open position. Further, the pocket door 340 depicted in FIG. 5 and FIG. 6 is not limited to having only the first panel 341 and the second panel 342. One of skill in the art may readily determine the number of panels utilized in configuring the pocket door 340. Further, in some embodiments, the panels 341-342 may not be entirely retracted beyond the boundary of the aperture 315, and in some embodiments, the shape of the aperture 315 may be non-rectangular, e.g., circular.

In use, when the user presses the push button 365, the pocket door 340 begins to move from the open position to the closed position. The pocket door 340 moves substantially parallel to the plane of the aperture 315 and across the aperture 315. Each panel 341-342 slides along a respective translational axis defined by the linear track 348, such that the first panel 341 and the second panel 342 slide along the linear track 348 towards the center of the aperture 315. The pocket door 340 may return to the closed position be substantially similar to that depicted in FIG. 5.

Figure 7:
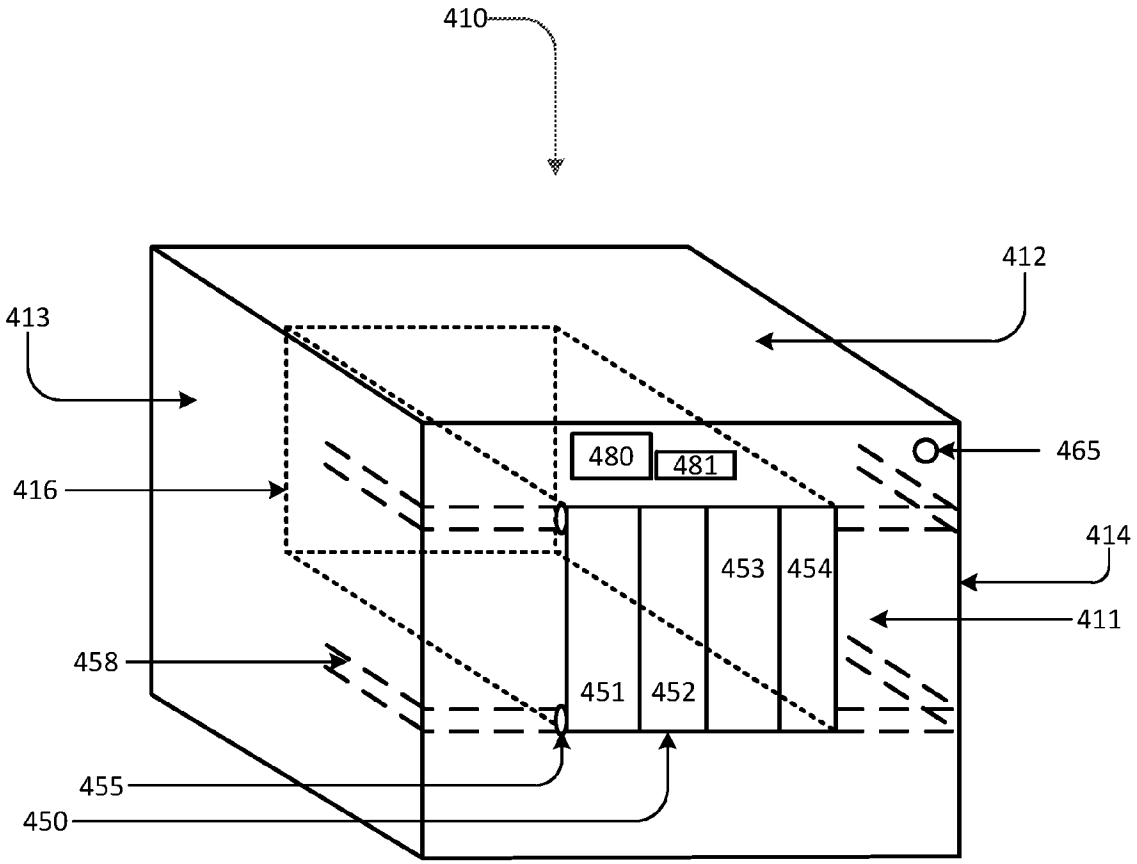
FIG. 7 is a perspective view of an example implementation of an oven with a pocket door movable along a curved track and in a closed position.
Figure 8:
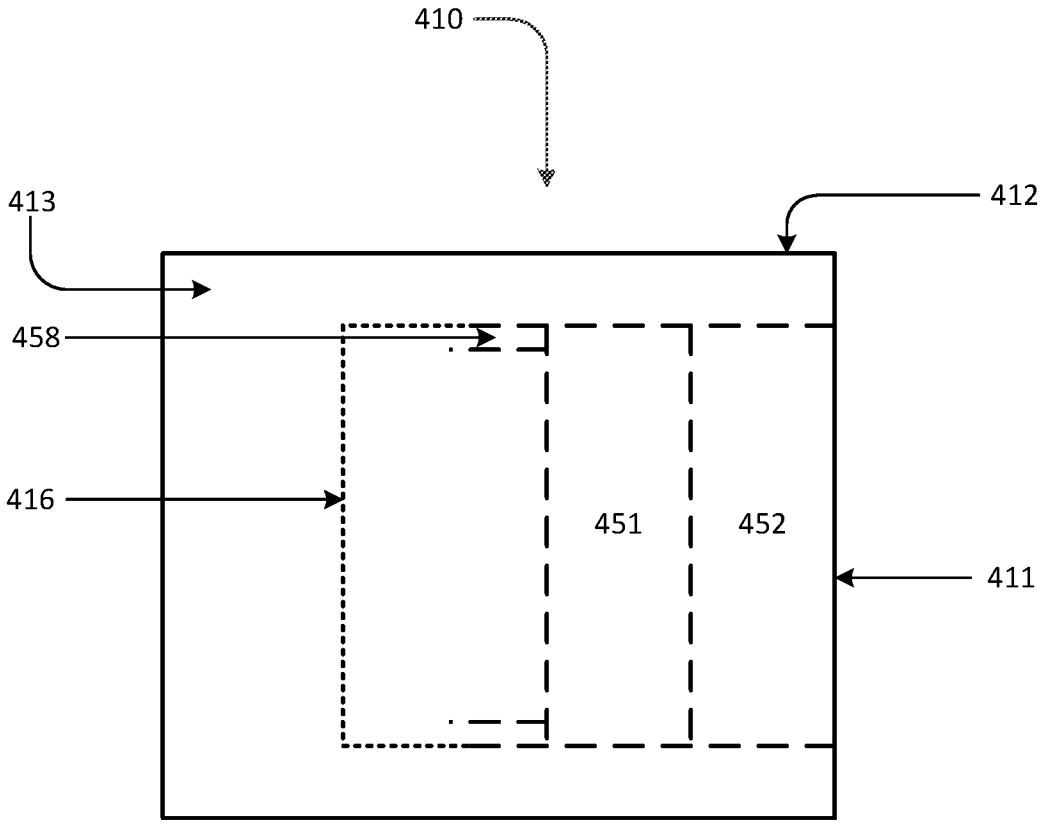
FIG. 8 is a side view of the oven of FIG. 7 with the pocket door in an open position.

Referring now to FIG. 7 and FIG. 8, another embodiment of an appliance, here an oven, is depicted having a housing or cabinet 410, an aperture 415, an interior compartment 416, and another example implementation of a slidable and retractable door taking the form of a pocket door 450. The housing 410 is defined in part by a front surface 411, a top surface 412, a first side surface 413, and a second side surface 414. The appliance may also include an appliance control system 480 and an appliance display 481. The appliance control system 480 allows a user to select various operational modes for the appliance and the appliance display 481 provides the user with a status of the selected operational mode. For example, the user may select a cook cycle for a frozen pizza using the appliance control system 480 and monitor the status of the cook cycle using the appliance display 481. In the depicted embodiment, the aperture 415 is defined by the front surface 411 of the housing 410, and the aperture 415 extends along a plane substantially parallel with the front surface 411 of the housing 410. Additionally, the interior compartment 416 is a cooking chamber.

In FIG. 7, the pocket door 450 is depicted in the closed position, such that the aperture 415 is closed, and in some instances sealed, and the interior compartment 416 is not accessible from outside the appliance. The pocket door 450 includes at least a first panel 451, a second panel 452, a third panel 453, and a fourth panel 454, which are disposed proximate to the aperture 415. In the closed position, the second panel 452 and the third panel 453 are configured to abut one another in the center of the aperture 415 to close the aperture 415. Each of at least the first panel 451, the second panel 452, the third panel 453, and the fourth panel 454 is connected to a curved track 458 within the housing 410 by a respective coupling mechanism 455 within the housing 410. The curved track 458 may be any appropriate plastic and/or metal or metal-alloy material. Each respective coupling mechanism 455 may be a wheel, chain, and/or any mechanism that connects each panel 451-454 to the curved track 458 and allows each panel 451-454 to slide along the curved track 458.

Each respective coupling mechanism 455 is connected to an actuation mechanism and allows the pocket door 450 to slide and retract between the closed position (FIG. 7) and the open position (FIG. 8). In the depicted embodiment of FIG. 7, the actuation mechanism is a push button 465 connected to a motor drive. The motor drive may be a linear motor, a rotary motor, a rack and pinion, etc. If the pocket door 450 is in the closed position and a user presses the push button 465, then the pocket door 450 will slide and retract to the open position. If the pocket door 450 is in the open position and the user presses the push button 465, then the pocket door 450 will slide and extend to the closed position.

In use, when the user presses the push button 465, the pocket door 450 begins to move from the closed position to the open position. The pocket door 450 moves substantially parallel to the plane of the aperture 415 and across the aperture 415. Each panel 451-454 will slide along a respective translational axis defined by the curved track 458, such that the first panel 451 and the second panel 452 slide along the curved track 458 towards the first side surface 413, and such that the third panel 453 and the fourth panel 454 slide along the curved track 458 towards the second side surface 414. The first panel 451 and the fourth panel 454 may slide along the curved track 458 and become substantially parallel with the first side surface 413 and the second side surface 414, respectively. Further, the second panel 452 and the third panel 453 may slide along the curved track 458 and become substantially parallel with the first side surface 413 and the second side surface 414, respectively. The pocket door 450 may slide and retract to the open position and the pocket door 450 will be substantially similar to that depicted in FIG. 8. Also, the pocket door 450 is substantially similar to that of a roll-top style door.

FIG. 8 provides a view of the first side surface 413 of the housing 410, wherein the pocket door 450 is depicted in the open position, such that the aperture 415 is open and the interior compartment 416 is accessible from outside the appliance. Each panel 451-454 is rectangular; however, this is not meant to be limiting. The shape of each panel 451-454 is generally based on the shape of the aperture 415 and the appliance housing 410. Additionally, as illustrated in FIG. 8, each panel 451-454 may be fully retracted within the housing 410 when the pocket door 450 is in the open position. Further, the pocket door 450 depicted in FIG. 7 and FIG. 8 is not limited to having only the first panel 451, the second panel 452, the third panel 453, and the fourth panel 454. One of skill in the art may readily determine the number of panels utilized in configuring the pocket door 450. Further, in some embodiments, the panels 451-454 may not be entirely retracted beyond the boundary of the aperture 415, and in some embodiments, the shape of the aperture 415 may be non-rectangular, e.g., circular.

In use, when the user presses the push button 465, the pocket door 450 begins to move from the open position to the closed position. The pocket door 450 moves substantially parallel to the plane of the aperture 415 and across the aperture 415. Each panel 451-454 slides along a respective translational axis defined by the curved track 458, such that the first panel 451, the second panel 452, the third panel 453, and the fourth panel 454 slide along the curved track 458 towards the center of the aperture 415. The pocket door 450 may return to the closed position and be substantially similar to that depicted in FIG. 7.

The panels 341-342 of the pocket door 340 and the panels 451-454 of the pocket door 450 are depicted as sliding towards both the first side surface 313, 413 and the second side surface 314, 414 in the depicted embodiments. However, they may all slide and retract into only the first side surface 313, 413 or the second side surface 314, 414 of the housing 310, 410. For example, the panels 341-342 of the pocket door 340 may all slide towards the first side surface 313 like a dumbwaiter style door.

The panels 341-342 of the pocket door 340 and the panels 451-454 of the pocket door 450 may be either clear or opaque and may be any appropriate plastic and/or metal or metal-alloy material. Examples of possible plastic materials that can be used for the panels include, but are not limited to polycarbonate (PC), polyethylene (PE), polyethylene terephthalate (PET), and polypropylene (PP). Examples of possible metal or metal-alloy materials that can be used for the panels 341-342, 451-454 include, but are not limited to aluminum, stainless steel, or cast iron.

It will be appreciated that the various embodiments disclosed in FIGS. 1-8 illustrate various combinations of features that may be combined differently in other applications. For example, manual or automatic actuation mechanisms may be employed in connection with any of the aforementioned door designs, and further, any of the aforementioned door designs may be used in connection with any of the various types of appliances mentioned herein. Aperture shapes, aperture positions, door shapes, door positions, etc. may also vary for different applications. Moreover, while the automatic actuation mechanisms disclosed herein focus on electrically-actuated mechanisms, it will be appreciated that other forms of actuation mechanisms may be employed in other applications, including, without limitation, magnetic, pneumatic and hydraulic actuation mechanisms. In additional embodiments, automatic actuation may also be based upon an operating cycle of an appliance, e.g., to automatically close at the start of a cycle or to automatically open at the end of a cycle.

Figure 9:
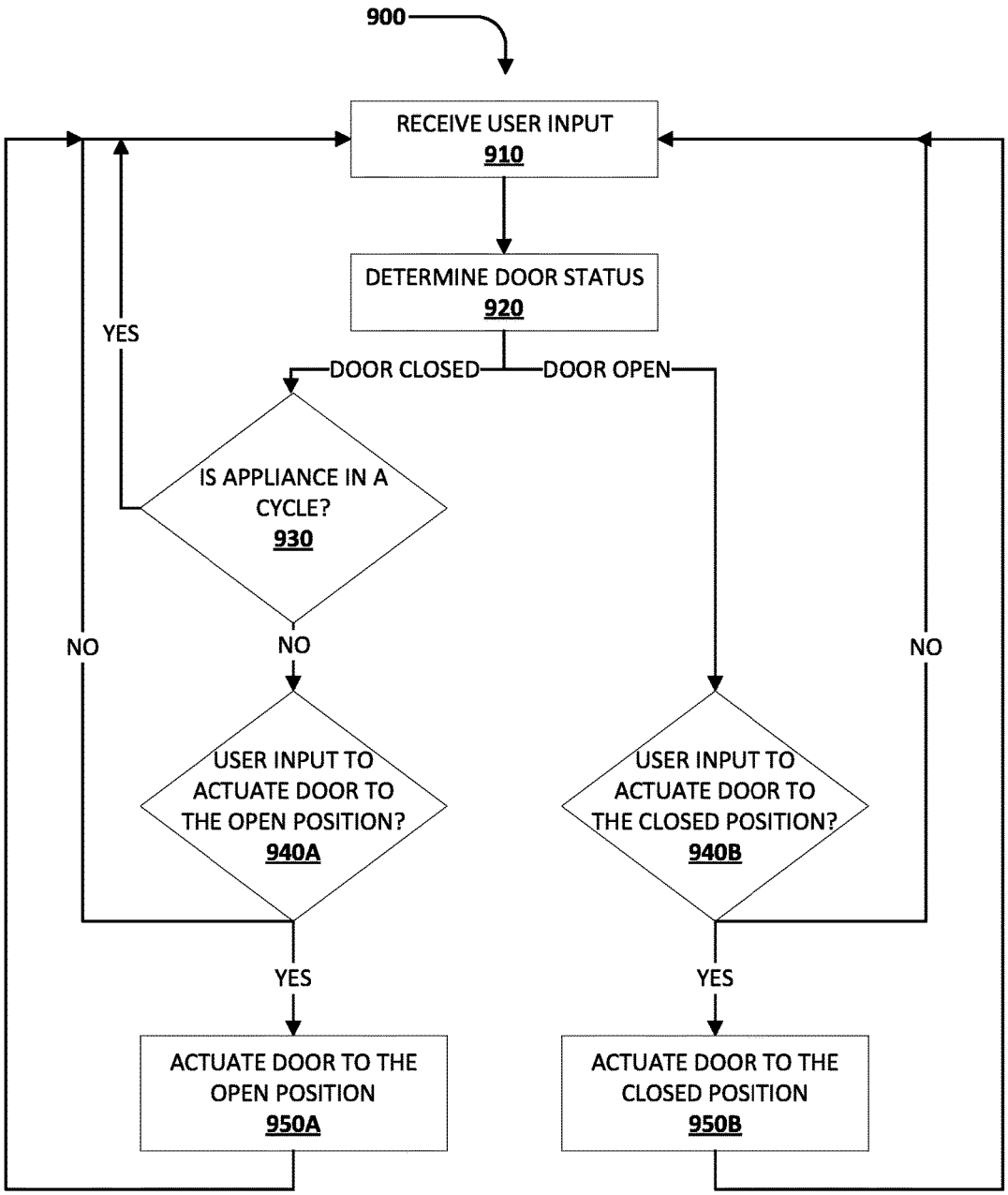
FIG. 9 is a flow chart of an exemplary process for automatically actuating an appliance door between a closed position and an open position.

FIG. 9 provides an exemplary process 900 for automatically actuating an appliance door between a closed position and an open position. The exemplary process 900 operates similarly for the appliance door designs disclosed herein, e.g., the overlapping iris door 120 (FIGS. 1-2), the non-overlapping iris door 230 (FIGS. 3-4), the pocket door 340 (FIGS. 5-6), and the pocket door 450 (FIGS. 7-8), so the aforementioned door designs will be referred to collectively as the appliance door.

The exemplary process 900 begins at step 910 by receiving user input to actuate the appliance from the closed position to the open position or from the open position to the closed position. In some embodiments, user input may be a signal initiated by a user that is transmitted over a network, i.e. a Local Area Network (LAN), Bluetooth, Wi-Fi, etc., by a user device, such as a smart watch, smart phone, or application thereon, and received by an appliance control system 180, 280, 380, and/or 480. In other embodiments, user input may be a signal initiated by a user that is received by a sensing device of an appliance control system 180, 280, 380, and/or 480, e.g., one or more physical buttons, controls, touchscreens, etc., one or more user gestures or user presence by an ultrasonic sensor or infrared sensor, one or more voice commands by an audio sensor, input by a biometric sensor, etc. In addition, in some embodiments, presence detection may be specific to particular locations of an appliance, e.g. proximate the door, or proximate a lower area of a floor supported appliance such that a user may trigger a door actuation with a foot while the user's hands are full. The exemplary process 900 will be described as utilizing an audio sensor to detect one or more voice commands to automatically actuate the appliance door between the closed position and the open position. One of skill in the art will recognize that this is not meant to be limiting, but simply for the sake of brevity.

Receiving user input at step 910 may be receiving one or more voice commands via an audio sensor. For example, to automatically actuate the appliance door from the closed position to the open position, a user may say "Open Appliance Door," "Open Door," "Open," etc. and to automatically actuate the appliance door from the open position to the closed position, the user may say "Close Appliance Door," "Close Door," "Close," etc. Once user input is received at step 910, the status of the appliance door is determined at step 920. If it is determined that the appliance door is closed, then the exemplary process 900 moves to step 930.

At step 930, it may be determined if an appliance is in a cycle. If the appliance is in a cycle, then the exemplary process 900 returns to step 910 to receive user input to prevent interrupting a cycle. For example, if the clothing washer of FIGS. 1-2 is in a cycle, a user says "Open Appliance Door," and the appliance door opens, then water and wet clothes in the washing drum may flow out of the aperture and onto the floor. Therefore, it may be disadvantageous to open the appliance door during the appliance cycle. If the appliance door is closed and the appliance is not in a cycle, then the exemplary process 900 moves to step 940A.

At step 940A, it may be determined if the voice command, i.e., user input, is indicative of a command to actuate the appliance door from the closed position to the open position, i.e. "Open Appliance Door." If the appliance door is closed, the appliance is not in a cycle, and the user sends a voice command to close the appliance door, then the exemplary process 900 may return to step 910 to receive user input. If the appliance door is closed, the appliance is not in a cycle, and the user sends a voice command to open the appliance door, then the exemplary process may move to step 950A. At step 950A, a signal may be sent to an actuation mechanism to open the appliance door. The exemplary process may then return to step 910 to receive user input.

Returning to step 920, if it is determined that the appliance door is open, then the exemplary process 900 moves to step 940B. It may be determined if the voice command, i.e., user input, is indicative of a command to actuate the appliance door from the open position to the closed position, i.e. "Close Appliance Door." If the appliance door is open and a user sends a voice command to open the appliance door, then the exemplary process 900 may return to step 910 to receive user input. If the appliance door is open and a user sends a voice command to close the appliance door, then the exemplary process may move to step 950B. At step 950B, a signal may be sent to an actuation mechanism to close the appliance door. The exemplary process may then return to step 910 to receive user input.

One of skill in the art will recognize that this is an exemplary process and one or more steps may be added, omitted, or rearranged.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least of A and B" (or, equivalently, "at least one of A or B," or equivalently, "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively as set forth in the United States Patent Office Manual of Patent Examining Procedures, Section 2111.03.

The foregoing description of several methods and embodiments have been presented for purposes of illustration. It is intended to be exhaustive or to limit the precise steps and/or forms disclosed, and obviously many modifications and variations are possible in light of the above teaching. It is intended that the scope and all equivalents be defined by the claims appended hereto.

What is claimed is:

1. An appliance, comprising:

a housing with an aperture extending along a plane and providing access to an interior compartment of the appliance; and a door slidable and retractable between at least a closed position to an open position;

wherein the door includes at least three panels configured in an iris arrangement;

wherein at least a portion of the door is configured to move substantially parallel to the plane of the aperture and across the aperture when actuating between the closed position and the open position;

wherein the door closes the aperture in the closed position; and wherein the door provides access to the interior compartment and is retracted into the housing in the open position.

2. The appliance of claim 1, wherein the aperture is defined by a top surface of the housing.

3. The appliance of claim 1, wherein the aperture is defined by a front surface of the housing.

4. The appliance of claim 1, wherein the door is configured to seal the aperture in the closed position.

5. The appliance of claim 1, further comprising at least one actuation mechanism connected to the door, wherein operation of the at least one actuation mechanism enables sliding and retraction of the door between the closed position and the open position.

6. The appliance of claim 5, wherein the at least one actuation mechanism is an automatic actuation mechanism.

7. The appliance of claim 6, further comprising a controller coupled to the automatic actuation mechanism and configured to actuate the door between the closed position and the open position in response to user input.

8. The appliance of claim 7, wherein the user input is a gesture, a voice input, a detected presence, or an input initiated with a user device.

9. The appliance of claim 5, wherein the at least one actuation mechanism is a manual actuation mechanism.

10. The appliance of claim 1, wherein the door includes at least a base plate within the housing and an actuating ring within the housing.

11. The appliance of claim 10, wherein each of the at least three panels of the door are configured to overlap in the closed position creating an overlapping iris door.

12. The appliance of claim 11, wherein each of the at least three panels of the overlapping iris door retract and extend around a respective rotational axis when actuating between the closed position and the open position.

13. The appliance of claim 10, wherein each of the at least three panels of the door are circular sectors and configured to abut one another in the closed position creating a non-overlapping iris door.

14. The appliance of claim 13, wherein each of the at least three panels of the non-overlapping iris door retract and slide along a respective translational axis when actuating between the closed position and the open position.

15. The appliance of claim 1, wherein the appliance is a clothing washer and the interior compartment includes a washing drum.

16. The appliance of claim 1, wherein the appliance is a clothing dryer and the interior compartment includes a drying tumbler.

17. The appliance of claim 1, wherein the appliance is a dishwasher and the interior compartment includes a washing rack.

18. The appliance of claim 1, wherein the appliance is an oven and the interior compartment is a cooking chamber.

19. An appliance door, comprising:

at least three panels movable in an iris arrangement and disposed proximate to an aperture of an appliance housing extending along a plane and providing access to an interior compartment of an appliance;

wherein each of the at least three panels is slidable and retractable between at least a closed position to an open position;

wherein each of the at least three panels is configured to move substantially parallel to the plane of the aperture and across the aperture when actuating between the closed position and the open position;

wherein the at least three panels close the aperture in the closed position; and wherein the at least three panels provide access to the interior compartment and are retracted into the appliance housing in the open position.

* * * * *